US011434918B2

(12) United States Patent
Sun et al.

(10) Patent No.: US 11,434,918 B2
(45) Date of Patent: Sep. 6, 2022

(54) PARTIALLY HOLLOW SHAFT FOR HVAC COMPRESSOR

(71) Applicant: Danfoss A/S, Nordborg (DK)

(72) Inventors: Zili Sun, Tallahassee, FL (US); Ruiguo Gao, Tallahassee, FL (US); Stefan Walshe, Dublin (IE); Aida Rezaei, Tallahassee, FL (US); Dongkoo Shin, Tallahassee, FL (US)

(73) Assignee: Danfoss A/S

( * ) Notice: Subject to any disclaimer, the term of this patent is extended or adjusted under 35 U.S.C. 154(b) by 635 days.

(21) Appl. No.: 16/448,422

(22) Filed: Jun. 21, 2019

(65) Prior Publication Data

US 2020/0400155 A1 Dec. 24, 2020

(51) Int. Cl.

| | |
|---|---|
| ***F04D 29/043*** | (2006.01) |
| ***F04D 29/048*** | (2006.01) |
| ***F25B 31/02*** | (2006.01) |

(52) U.S. Cl.

CPC ..... *F04D 29/043* (2013.01); *F04D 29/048* (2013.01); *F25B 31/026* (2013.01)

(58) Field of Classification Search

CPC .... F04D 29/286; F04D 29/043; F04D 29/048; F04D 29/053; F25B 1/053; F25B 1/10; F25B 31/026

See application file for complete search history.

(56) References Cited

U.S. PATENT DOCUMENTS

| | | | | |
|---|---|---|---|---|
| 2,065,955 | A | 12/1936 | Waseige | |
| 3,269,146 | A | 8/1966 | Stanley | |
| 7,942,646 | B2 | 5/2011 | Zhou et al. | |
| 2011/0120176 | A1* | 5/2011 | Soliz | F04B 7/04 62/470 |
| 2015/0167687 | A1* | 6/2015 | Kurihara | F04D 29/056 415/229 |
| 2018/0062467 | A1* | 3/2018 | Barthes | F01D 15/10 |

FOREIGN PATENT DOCUMENTS

| | | | | |
|---|---|---|---|---|
| CN | 110332019 | A * | 10/2019 | F01D 15/08 |

* cited by examiner

*Primary Examiner* — Ana M Vazquez

(74) *Attorney, Agent, or Firm* — Carlson, Gaskey & Olds, P.C.

(57) ABSTRACT

This disclosure relates to a compressor having a partially hollow shaft. In particular, an exemplary compressor includes a shaft which is partially hollow, and at least one impeller rotatably coupled to the shaft. The compressor may be a refrigerant compressor used in a heating, ventilation, and air conditioning (HVAC) chiller system.

21 Claims, 3 Drawing Sheets

PARTIALLY HOLLOW SHAFT FOR HVAC COMPRESSOR

TECHNICAL FIELD

This disclosure relates to a compressor having a partially hollow shaft. The compressor may a refrigerant compressor be used in a heating, ventilation, and air conditioning (HVAC) chiller system, for example.

BACKGROUND

Refrigerant compressors are used to circulate refrigerant in a chiller via a refrigerant loop. Refrigerant loops are known to include a condenser, an expansion device, and an evaporator. The compressor compresses the fluid, which then travels to a condenser, which in turn cools and condenses the fluid. The refrigerant then goes to an expansion device, which decreases the pressure of the fluid, and to the evaporator, where the fluid is vaporized, completing a refrigeration cycle.

Many refrigerant compressors are centrifugal compressors and have an electric motor that drives at least one impeller to pressurize refrigerant. The at least one impeller is mounted to a rotatable shaft.

SUMMARY

A refrigerant compressor according to an exemplary aspect of the present disclosure includes, among other things, a shaft which is partially hollow, and at least one impeller rotatably coupled to the shaft.

In a further non-limiting embodiment of the foregoing refrigerant compressor, the shaft includes a first cavity and a second cavity spaced-apart from the first cavity.

In a further non-limiting embodiment of any of the foregoing refrigerant compressors, the first cavity is greater than the second cavity by volume.

In a further non-limiting embodiment of any of the foregoing refrigerant compressors, a length dimension of the first cavity is greater than a length dimension of the second cavity.

In a further non-limiting embodiment of any of the foregoing refrigerant compressors, a radial dimension of the first cavity is less than a radial dimension of the second cavity.

In a further non-limiting embodiment of any of the foregoing refrigerant compressors, the second cavity is radially stepped.

In a further non-limiting embodiment of any of the foregoing refrigerant compressors, the first cavity is spaced-apart from the second cavity by magnetic material.

In a further non-limiting embodiment of any of the foregoing refrigerant compressors, the shaft includes an outer sleeve, and the first and second cavities are arranged radially inwardly of the outer sleeve.

In a further non-limiting embodiment of any of the foregoing refrigerant compressors, the outer sleeve is made of non-metallic material.

In a further non-limiting embodiment of any of the foregoing refrigerant compressors, the shaft includes a first plug adjacent the first cavity and configured to connect to the at least one impeller.

In a further non-limiting embodiment of any of the foregoing refrigerant compressors, the at least one impeller includes a first impeller mounted adjacent a first end of the shaft and a second impeller mounted adjacent a second end of the shaft opposite the first end.

In a further non-limiting embodiment of any of the foregoing refrigerant compressors, the first plug is connected to the first impeller, and the shaft includes a second plug connected to the second impeller.

In a further non-limiting embodiment of any of the foregoing refrigerant compressors, the first plug and the second plug are formed separately from a remainder of the shaft.

In a further non-limiting embodiment of any of the foregoing refrigerant compressors, the shaft includes a radially-projecting tab serving as an axial magnetic bearing or a position sensor.

In a further non-limiting embodiment of any of the foregoing refrigerant compressors, a natural frequency of the shaft is increased between about 5% and 50% relative to a substantially similarly-arranged solid shaft.

In a further non-limiting embodiment of any of the foregoing refrigerant compressors, the refrigerant compressor is used in a heating, ventilation, and air conditioning (HVAC) chiller system.

In a further non-limiting embodiment of any of the foregoing refrigerant compressors, the refrigerant compressor includes magnetic bearings, gas bearings, or foil bearings are configured to support the shaft.

A refrigerant system according to an exemplary aspect of the present disclosure includes, among other things, a main refrigerant loop including a compressor, a condenser, an evaporator, and an expansion device. The compressor includes a shaft which is partially hollow and at least one impeller rotatably coupled to the shaft.

In a further non-limiting embodiment of the foregoing refrigerant system, the shaft includes a first cavity and a second cavity spaced-apart from the first cavity, and the first cavity is greater than the second cavity by volume.

In a further non-limiting embodiment of any of the foregoing refrigerant systems, a natural frequency of the shaft is increased between about 5% and 50% relative to a solid shaft.

DETAILED DESCRIPTION

Figure 1:
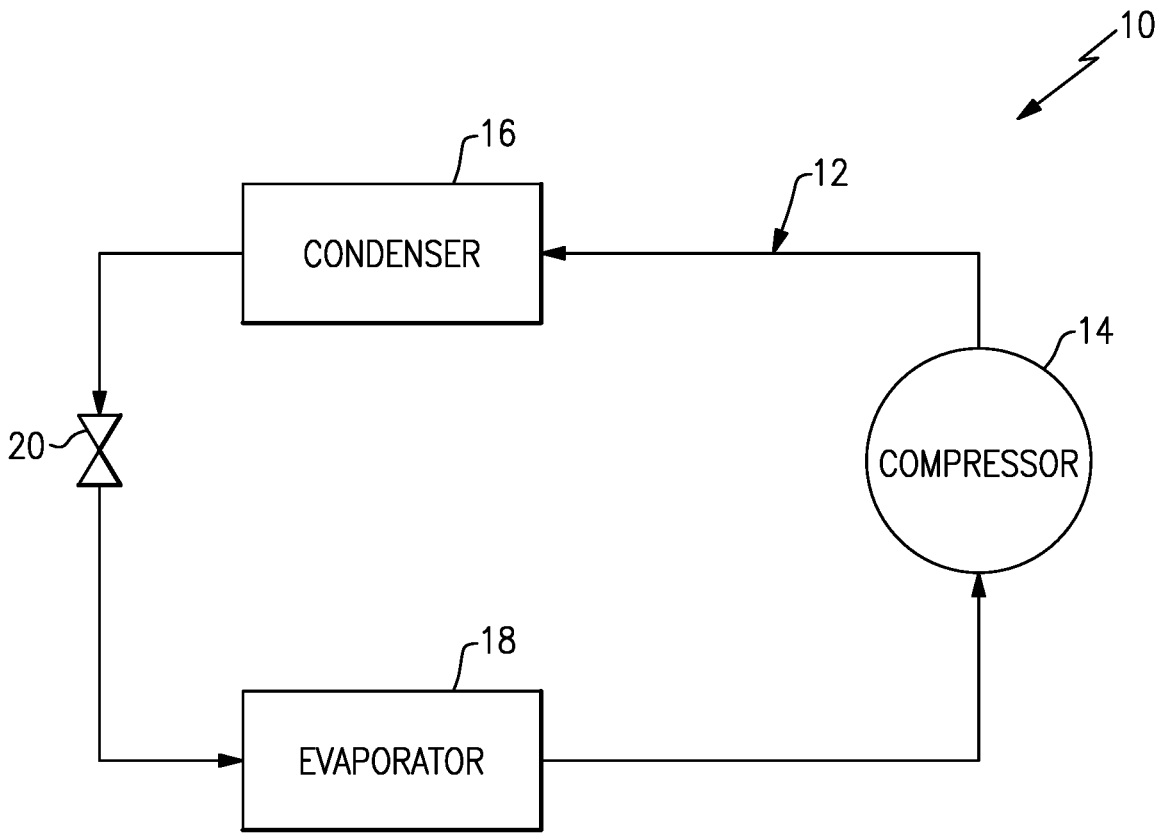
FIG. 1 schematically illustrates an example refrigerant system.

FIG. 1 illustrates a refrigerant system 10. The refrigerant system 10 includes a main refrigerant loop, or circuit, 12 in communication with a compressor 14, a condenser 16, an evaporator 18, and an expansion device 20. This refrigerant system 10 may be used in a chiller, for example. In that example, a cooling tower may be in fluid communication with the condenser 16. While a particular example of the refrigerant system 10 is shown, this application extends to other refrigerant system configurations, including configurations that do not include a chiller. For instance, the main refrigerant loop 12 can include an economizer downstream of the condenser 16 and upstream of the expansion device 20.

Figure 2:
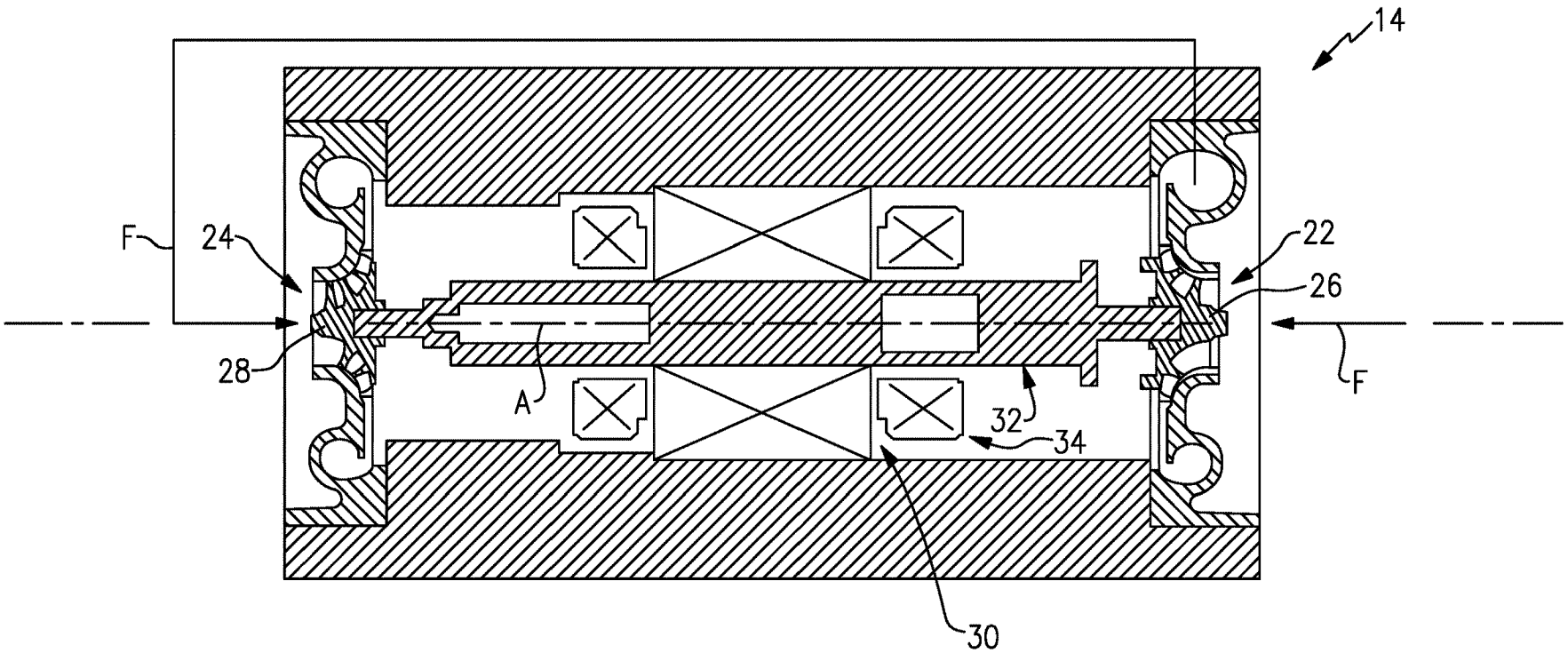
FIG. 2 schematically illustrates an example compressor having two compression stages.

FIG. 2 schematically illustrates an example refrigerant compressor 14 according to this disclosure. In this example, the compressor 14 has two compression stages 22, 24 arranged in series and spaced-apart from one another along a central longitudinal axis A of the compressor 14. This disclosure is not limited to compressors with serially-arranged compression stages, nor is this disclosure limited to compressors with two compression stages, however. This disclosure extends to compressors with one or more compression stages.

In the example of FIG. 2, the compression stages 22, 24 each include an impeller 26, 28 rotatable about the axis A via a motor 30. In this example, the motor 30 is an electric motor arranged about the axis A, and the impellers 26, 28 are rotatably coupled and directly connected to a shaft 32 which is configured to be rotatably driven about the axis A by the motor 30. The impellers 26, 28 are mounted adjacent opposite ends of the shaft 32. This arrangement may be referred to as a back-to-back impeller arrangement. This disclosure is not limited to back-to-back arrangements, however. The shaft 32 will be described in more detail with reference to FIG. 3. The shaft 32 may be rotatably supported by magnetic bearings 34 or by other bearings, such as gas bearings including static and dynamic gas bearings like foil bearings or rigid grooved bearings. To this end, the shaft 32 may be run at relatively high speeds.

With continued reference to FIG. 2, during use, fluid F, such as refrigerant, enters the compressor 14 and is pressurized by impeller 26 within the first compression stage 22. The outlet of the first compression stage 22 is fluidly coupled to the inlet of the second compression stage 24 in this example, as schematically shown in FIG. 2. As such, the fluid F is again pressurized by the impeller 28 within the second compression stage 24. The outlet of the second compression stage 24 is fluidly coupled to the main refrigerant loop 12, and in particular the condenser 16.

Further detail of the shaft 32 will now be described relative to FIG. 3. In this example, the shaft 32 is arranged about the axis A and includes a length dimension extending generally between a first end 36 to a second end 38. The shaft 32 includes an outer surface 40, in this example, which defines a portion of the radial outer surface of the shaft 32 and exhibits a radial dimension $R_1$. The radial direction R is shown in FIG. 3 for ease of reference and is normal to the axis A.

Radially inward of the outer surface 40, the shaft 32 is partially hollow and includes at least one cavity. In this disclosure, a cavity is an empty space. In particular, a cavity is bound by solid material but is devoid of solid material. Further, the cavities in this disclosure are bound on all sides (i.e., fully enclosed) and are not open to the outside of the shaft 32.

Figure 3:
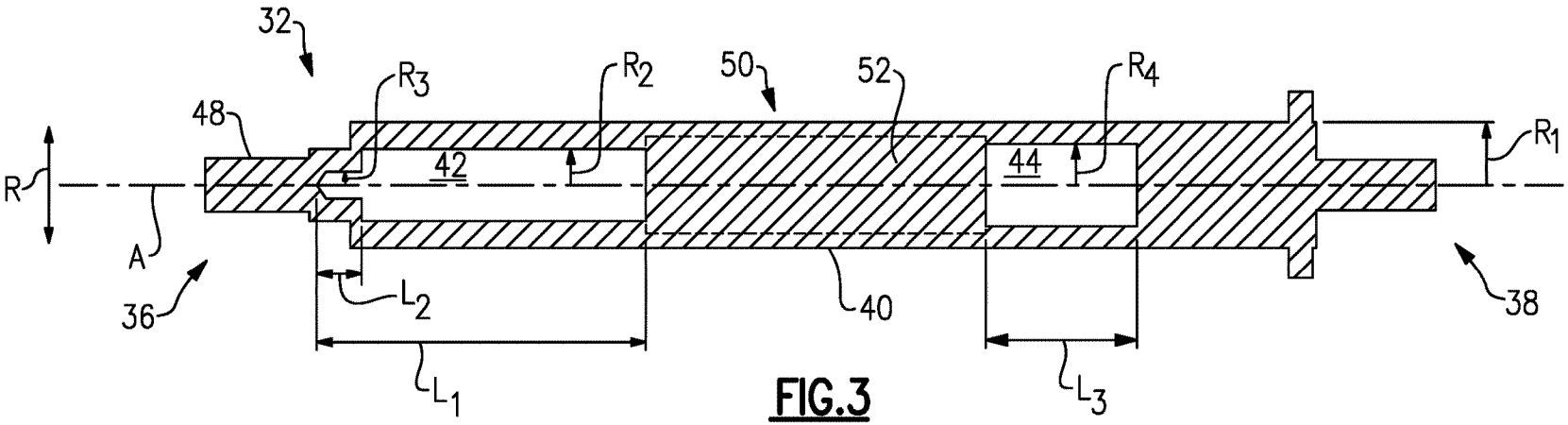
FIG. 3 illustrates an example shaft according to this disclosure.
Figure 4:
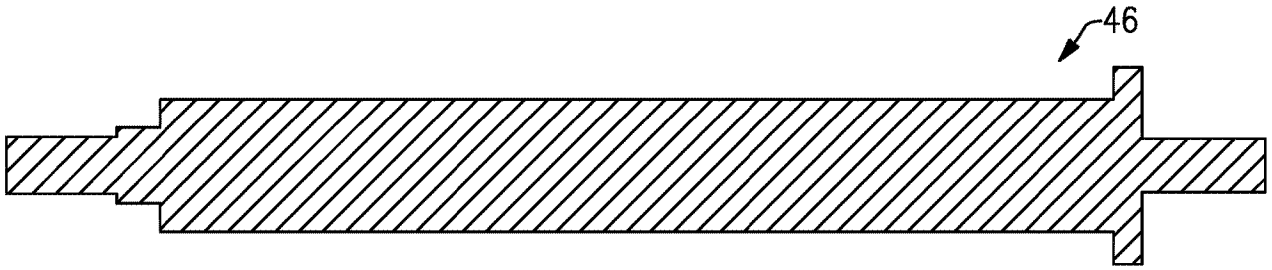
FIG.4 Prior Art
FIG. 4 illustrates a known, prior art shaft.

In the example of FIG. 3, the shaft 32 includes a first cavity 42 and a second cavity 44 arranged radially inward of the outer surface 40. The first and second cavities 42, 44 are configured and arranged such that the shaft 32 is lighter than it would be if it were entirely solid, as in the example of FIG. 4, which illustrates a known shaft 46. In a particular aspect of the disclosure, the reduced weight of the shaft 32 increases the natural frequency of the shaft 32 such that it may be rotated at higher speeds than substantially similarly-arranged solid shafts, such as shaft 46 (i.e., substantially all things about the two shafts being equal, other than the shaft 32 being partially hollow), without causing undue vibrations. In one specific example, a natural frequency of the shaft 32 is increased between about 5% to 50% relative to a similarly-arranged solid shaft, and the shaft 32 may rotate between about 5% to 50% faster than a similarly-arranged solid shaft without causing undue vibrations. In a further example, the natural frequency of the shaft 32 is increased by about 20% relative to a similarly-arranged solid shaft. Further, while the weight of the shaft 32 is reduced, the stiffness of the shaft 32 is not materially compromised.

When the shaft 32 includes more than one cavity, as in the example of FIG. 3, the cavities need not exhibit the same volume, although in some examples the cavities may have the same volume. For instance, in FIG. 3, the first cavity 42 is greater than the second cavity 44 by volume. In particular, the first and second cavities 42, 44 are substantially cylindrical in this example, and may be formed by milling, drilling, or other known machining processes. The shaft 32 may also be additively manufactured and may exhibit a functionally graded composition.

The first cavity 42, in this example, exhibits an overall length dimension $L_1$ and exhibits a radial dimension $R_2$ throughout the majority of the length dimension $L_1$. In this example, the first cavity 42 is radially stepped, meaning it exhibits a reduced radial dimension over a portion of the length $L_1$. In particular, the first cavity 42 exhibits a reduced radial dimension $R_3$ over a length dimension $L_2$. The radially stepped arrangement is provided by a plug 48 formed separately from the remainder of the shaft 32, in this example, which is received within the first cavity 42 and attached thereto using known methods, such as welding, for example. An outer surface of the plug 48 is configured to directly connect to the second impeller 28, in this example.

The second cavity 44 exhibits an overall length dimension $L_3$ and a radial dimension $R_4$. The length dimension $L_1$ of the first cavity 42 is greater than the length dimension $L_3$ of the second cavity 44, in this example, while the radial dimension $R_4$ of the second cavity 44 is greater than the radial dimensions $R_2$, $R_3$ of the first cavity 42. Again, the first cavity 42 defines a greater volume than the second cavity 44 in this example. The second cavity 44 does not receive a plug, such as the plug 48, however it could be arranged to receive a plug similar to the plug 48 in other examples. In that case, the plug would also be configured to directly contact the impeller 26. Further, while shown as separate components, the plugs, such as the plug 48, could be formed integrally with the remainder of the shaft 32.

Figure 5:
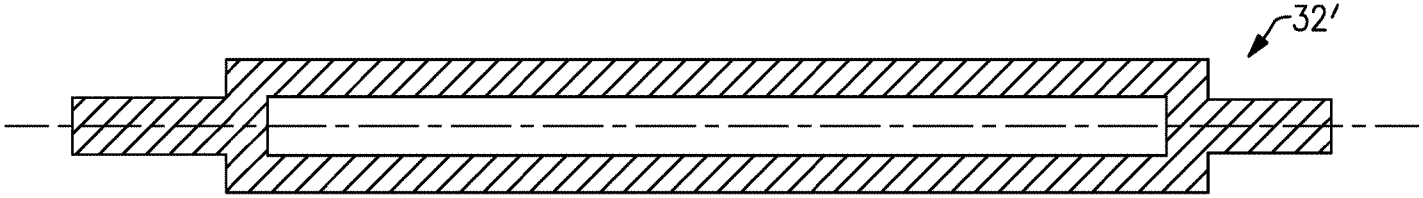
FIG. 5 illustrates another example shaft according to this disclosure.

In the example of FIG. 3, the first and second cavities 42, 44 are fully enclosed and spaced-apart from one another by a solid central section 50 of the shaft 32. In this example, the central section 50 of the shaft may include magnetic material 52, which is represented by dashed lines in FIG. 3. The magnetic material 52 may be held under compression. To this end, the remainder of the shaft 32 may urge the magnetic material 52 in opposing axial directions toward the center of the shaft. While a solid central section 50 is shown in FIG. 3, in other examples the central section 50 could be at least partially hollow such that the first and second cavities 42, 44 define a single cavity. Again, this disclosure extends to shafts having one or more cavities, such as the shaft 32' of FIG. 5 which includes a single cavity.

The outer surface 40 of the shaft 32 may be defined by a cylindrical sleeve in one example. The shaft 32 may also include one or more locating features projecting radially outward beyond the radial dimension $R_1$. In this example, the shaft includes a radially-projecting tab serving as either an axial magnetic bearing or a position sensor, as examples.

While specific materials and methods of manufacturing the shaft 32 are mentioned above, they are non-limiting. The shaft 32 may be manufactured using one or more known manufacturing processes and may be made of known materials appropriately suited to particular applications. Further, the shaft 32 may be formed as a single, integral piece or of a plurality of separately-formed pieces which are then connected together using known processes such as welding.

It should be understood that terms such as "axial" and "radial" are used above with reference to the normal operational attitude of a compressor. Further, these terms have been used herein for purposes of explanation, and should not be considered otherwise limiting. Terms such "generally," "about," and "substantially" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A refrigerant compressor, comprising:

a shaft, wherein the shaft is partially hollow, wherein the shaft includes at least one cavity bound on all sides such that the at least one cavity is fully enclosed and does not open to an outside of the shaft; and at least one impeller rotatably coupled to the shaft.

2. The refrigerant compressor as recited in claim 1, wherein the shaft includes a first cavity and a second cavity spaced-apart from the first cavity.

3. The refrigerant compressor as recited in claim 2, wherein the first cavity is greater than the second cavity by volume.

4. The refrigerant compressor as recited in claim 3, wherein a length dimension of the first cavity is greater than a length dimension of the second cavity.

5. The refrigerant compressor as recited in claim 4, wherein a radial dimension of the first cavity is less than a radial dimension of the second cavity.

6. The refrigerant compressor as recited in claim 3, wherein the second cavity is radially stepped.

7. The refrigerant compressor as recited in claim 2, wherein the first cavity is spaced-apart from the second cavity by magnetic material.

8. The refrigerant compressor as recited in claim 2, wherein:

the shaft includes an outer sleeve, and the first and second cavities are arranged radially inwardly of the outer sleeve.

9. The refrigerant compressor as recited in claim 8, wherein the outer sleeve is made of non-metallic material.

10. The refrigerant compressor as recited in claim 8, wherein the shaft includes a first plug adjacent the first cavity and configured to connect to the at least one impeller.

11. The refrigerant compressor as recited in claim 10, wherein the at least one impeller includes a first impeller mounted adjacent a first end of the shaft and a second impeller mounted adjacent a second end of the shaft opposite the first end.

12. The refrigerant compressor as recited in claim 11, wherein:

the first plug is connected to the first impeller, and the shaft includes a second plug connected to the second impeller.

13. The refrigerant compressor as recited in claim 12, wherein the first plug and the second plug are formed separately from a remainder of the shaft.

14. The refrigerant compressor as recited in claim 1, wherein the shaft includes a radially-projecting tab serving as an axial magnetic bearing or a position sensor.

15. The refrigerant compressor as recited in claim 1, wherein a natural frequency of the shaft is increased between 5% to 50% relative to a substantially similarly-arranged solid shaft.

16. The refrigerant compressor as recited in claim 1, wherein the refrigerant compressor is used in a heating, ventilation, and air conditioning (HVAC) chiller system.

17. The refrigerant compressor as recited in claim 1, further comprising magnetic bearings, gas bearings, or foil bearings configured to support the shaft.

18. A refrigerant system comprising:

a main refrigerant loop including a compressor, a condenser, an evaporator, and an expansion device, wherein the compressor includes:

a shaft, wherein the shaft is partially hollow and includes at least one cavity, wherein the at least one cavity is bound on all sides such that the at least one cavity is fully enclosed and does not open to an outside of the shaft; and at least one impeller rotatably coupled to the shaft.

19. The refrigerant system as recited in claim 18, wherein:

the at least one cavity includes a first cavity and a second cavity spaced-apart from the first cavity, and the first cavity is greater than the second cavity by volume.

20. The refrigerant system as recited in claim 18, wherein a natural frequency of the shaft is increased between 5% and 50% relative to a solid shaft.

21. A refrigerant compressor, comprising:

a shaft, wherein the shaft is partially hollow; and at least one impeller rotatably coupled to the shaft;

wherein the shaft includes a first cavity and a second cavity spaced-apart from the first cavity, wherein the first and second cavities are both bound on all sides such that the first and second cavities are fully enclosed and do not open to an outside of the shaft.

* * * * *